US008540175B2

(12) United States Patent
Torres et al.

(10) Patent No.: US 8,540,175 B2
(45) Date of Patent: Sep. 24, 2013

(54) METHOD AND DEVICE FOR CONTROLLING THE OPERATION OF A GYRATORY CRUSHER

(75) Inventors: Mauricio Torres, Malmö (SE); Mats Lindqvist, Svedala (SE); Kjell-Åke Svensson, Limhamn (SE)

(73) Assignee: Sandvik Intellectual Property AB, Sandviken (SE)

( * ) Notice: Subject to any disclaimer, the term of this patent is extended or adjusted under 35 U.S.C. 154(b) by 635 days.

(21) Appl. No.: 12/659,477

(22) Filed: Mar. 10, 2010

(65) Prior Publication Data

US 2010/0230519 A1 Sep. 16, 2010

(30) Foreign Application Priority Data

Mar. 11, 2009 (SE) ..... 0900312

(51) Int. Cl.
*B02C 25/00* (2006.01)

(52) U.S. Cl.
USPC ..... 241/30; 241/207; 241/209; 241/217

(58) Field of Classification Search
USPC ..... 241/30, 207–217
See application file for complete search history.

(56) References Cited

U.S. PATENT DOCUMENTS

| | | | | |
|---|---|---|---|---|
| 4,793,560 | A | 12/1988 | Schrödl | |
| 2006/0243833 | A1 * | 11/2006 | Nilsson | 241/30 |

FOREIGN PATENT DOCUMENTS

| | | |
|---|---|---|
| WO | 2004/069415 | 8/2004 |
| WO | 2005/007293 | 1/2005 |
| WO | 2008/103096 | 8/2008 |
| WO | 2008/153454 | 12/2008 |

OTHER PUBLICATIONS

Swedish Office Action mailed Sep. 16, 2009 issued in Swedish Application No. 0900312-0 including English translation in appended International Search Report.

International Preliminary Report for PCT/SE2010/050188, dated Sep. 13, 2011.

Written Opinion of the International Search Report for PCT/SE2010/050188, dated Jun. 6, 2010.

* cited by examiner

*Primary Examiner* — Bena Miller

(74) *Attorney, Agent, or Firm* — Morgan, Lewis & Bockius LLP

(57) ABSTRACT

A gyratory crusher comprises a first crushing shell mounted on a crushing head, and a second crushing shell mounted on a machine frame, a crushing gap being formed between said first and second crushing shells. A method of controlling the operation of said crusher comprises measuring a parameter being representative of the stresses to which the crusher is exposed during the crushing of material, determining an average value of said parameter, determining a deviation value of said parameter, calculating a peak value based on said average value and said deviation value, comparing said peak value to a reference value, and controlling the operation of the crusher in view of said comparison between said peak value and said reference value.

12 Claims, 5 Drawing Sheets

METHOD AND DEVICE FOR CONTROLLING THE OPERATION OF A GYRATORY CRUSHER

CROSS-REFERENCE TO PRIOR APPLICATION

This application claims priority to Sweden Application No. 0900312-0 filed Mar. 11, 2009, which is incorporated by reference herein.

TECHNICAL FIELD OF THE INVENTION

The present invention relates to a method of controlling the operation of a gyratory crusher, which comprises a first crushing shell mounted on a crushing head, and a second crushing shell mounted on a machine frame, a crushing gap being formed between said first and second crushing shells, material to be crushed being fed to said crushing gap.

The present invention also relates to a control device for controlling the operation of a gyratory crusher.

BACKGROUND OF THE INVENTION

Crushers are utilized in many applications for crushing hard material, such as rocks, ore etc. One type of crusher is the gyratory crusher, which has a crushing head which is forced to gyrate inside a fixed crushing shell.

The crushing of pieces of rock, ore, etc., causes, by nature, a varying load on the crusher. During the operation of a crusher it is desirable that the crusher operates in such a manner that premature break-down of the crusher is avoided.

WO 2005/007293 describes a method of controlling a crusher. The instantaneous load on the crusher is measured. For each of a number of time intervals, a highest pressure is identified. Based on a number of such measured highest pressures, a mean peak pressure is identified. The operation of the crusher is based on a comparison between the measured mean peak pressure and a set point.

SUMMARY AND OBJECTS OF THE INVENTION

It is an object of the present invention to provide a method of controlling the operation of a crusher in such a manner that the risk of an early break-down due to metal fatigue is reduced.

This object is achieved by means of a method of controlling the operation of a gyratory crusher, which comprises a first crushing shell mounted on a crushing head, and a second crushing shell mounted on a machine frame, a crushing gap being formed between said first and second crushing shells, material to be crushed being fed to said crushing gap, the method comprising measuring a parameter being representative of the stresses to which the crusher is exposed during the crushing of material, determining an average value of said parameter, determining a deviation value of said parameter, calculating a peak value based on said average value and said deviation value, comparing said peak value to a reference value, and controlling the operation of the crusher in view of said comparison between said peak value and said reference value.

An advantage of this method is that the crusher is controlled both in view of the average stresses and in view of the deviation of the stresses. Thus, the method accounts both for how high the stresses are, and also for how much the stresses vary. Thus, a more relevant manner of controlling the crusher in view of the risk of fatigue failure is obtained. As a consequence, the risk of unexpected fatigue failures is reduced. Furthermore, the present method of controlling the operation of a crusher promotes an operation in which the variations in the load on the crusher are decreased. Thus, there is an incitement for an operator to operate the crusher at as even load conditions as possible, since that provides increased crushing efficiency, without decreasing the technical life of the crusher.

According to one embodiment, said parameter is chosen among a measured mechanical stress in the crusher, a pressure in a hydraulic system controlling the width of said crushing gap, and a power of a motor driving the crusher. All these types of parameters represent the stresses on the crusher well, and are comparably easy to measure.

According to one embodiment, the calculation of said peak value comprises adding said average value of said parameter multiplied by a first constant, and said deviation value of said parameter multiplied by a second constant. An advantage of this embodiment is that both the average value and the deviation value are accounted for in a relevant manner. Furthermore, it is possible to alternate the weight of the average value and the deviation value in relation to each other by changing the values of the constants. Thus, it becomes possible to adapt the calculation method to account for practical experiences concerning, e.g., actual observations of technical life of crushers at different types of operating conditions.

According to one embodiment, said peak value is calculated in accordance with the following equation:

$$\text{peak value}=K1*\text{average value}+K2*\text{deviation value}.$$

According to one embodiment, K1 is about 1, and K2 is from about 0.5 to about 5.

According to one embodiment, said average value, said deviation value, and said peak value are determined based on values of said parameter measured during a time interval that is a multiple of the rotation period of the eccentric of the crusher, i.e., a multiple of the time it takes for the eccentric to complete a full turn. The shorter the time interval is during which the stresses are measured the more rapid is the response of this signal to stress variations. Preferably, the time interval would correspond to 1-10 rotation periods. The duration of a typical rotation period of a gyratory crusher is 150-300 ms, and, hence, the typical length of a time interval is from 150 ms and up to 3 seconds. Even longer time intervals could also be utilized, although a short time interval, such as a time interval corresponding to only 1-3 rotation periods, is often preferred due to the quicker response to rapid changes in the operating conditions, such rapid changes including, for example, uncrushable objects entering the crusher. It has been found that a time interval of this length provides a relevant basis for controlling the crusher, in view of the typical rate of changes in the crushing process of a gyratory crusher.

According to one embodiment, said average value, said deviation value, and said peak value are moving values. By utilizing moving values, that are regularly updated based on new measured values, the control of the crusher adapts to changes in the operating conditions.

According to one embodiment, said method comprises controlling the width of said crushing gap in view of said comparison between said peak value and said reference value. An advantage of this embodiment is that controlling the width of the crushing gap provides a very quick response in the stresses on the crusher. Hence, if said peak value exceeds said reference value, a change in the width of the crushing gap will very quickly result in the peak value decreasing.

According to one embodiment, said deviation value of said parameter is the standard deviation value of said parameter. The standard deviation value of the measured parameter is normally quite easy to calculate by means of standard calculating techniques, and is a relevant indicator of how much the measured parameter deviates from its own average value.

According to another embodiment the deviation value of said parameter is the magnitude of the Fourier component at the frequency of rotation of an eccentric of the crusher, said eccentric being operative for making the crushing head gyrate. An advantage of this embodiment is that it is simple, and hence efficient, to calculate the Fourier component, compared to many other deviation values. A further advantage of this embodiment is that the Fourier component, being calculated at the frequency of rotation of the eccentric of the crusher, gives a higher weight to systematic variations in the load on the crusher, such variations being due to, for example, uneven feeding of material, and less weight to the load "noise", which is inherent in the crushing process as such.

It is a further object of the present invention to provide a control device for controlling the operation of a gyratory crusher, by means of which control device the crusher can be controlled in a more efficient manner.

This object is achieved with a control device for controlling the operation of a gyratory crusher, which comprises a first crushing shell mounted on a crushing head, and a second crushing shell mounted on a machine frame, a crushing gap being formed between said first and second crushing shells, said crushing gap being operative for receiving material to be crushed, said control device comprising: means for receiving measurements of a parameter being representative of the stresses to which the crusher is exposed during the crushing of material, means for determining an average value of said parameter, means for determining a deviation value of said parameter, means for calculating a peak value based on said average value and said deviation value, means for comparing said peak value to a reference value, and means for controlling the operation of the crusher in view of said comparison between said peak value and said reference value.

An advantage of this control device is that it accounts for both the level of the stresses and the variations in the stresses when controlling the crusher. This makes it easier to predict the occurrence of fatigue failures in the crusher, and to optimize the relation between technical life and crushing efficiency. Furthermore, the control device provides incentives for reducing the variations in the load on the crusher, since a small deviation value makes it possible to operate at higher mean stresses and with an increased size reduction of the material to be crushed, such that an improved crushing efficiency may be obtained without decreasing the technical life of the crusher.

In another embodiment of the invention, a gyratory crusher is provided with the control device as described above.

These and other aspects of the invention will be apparent from and elucidated with reference to the claims and the embodiments described hereinafter.

BRIEF DESCRIPTION OF THE DRAWINGS

The invention will hereafter be described in more detail and with reference to the appended drawings.

DETAILED DESCRIPTION OF THE PREFERRED EMBODIMENTS

In the present description the sign "σ" (sigma) has been utilized for denoting a stress, while the mathematical term "standard deviation", which may sometimes in other documents be denoted with that same symbol, has been denoted "s.d." in the present document.

Figure 1:
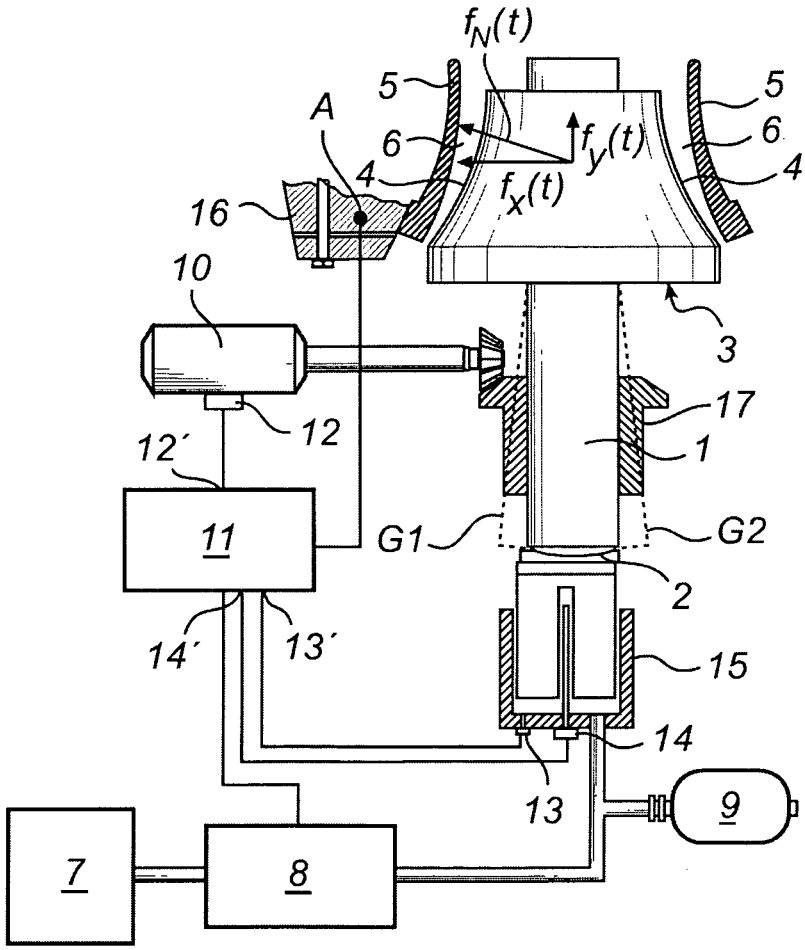
FIG. 1 is a schematic side view of a gyratory crusher.

FIG. 1 illustrates, schematically, a gyratory crusher which has a shaft 1. At the lower end 2 thereof, the shaft 1 is eccentrically mounted. At the upper end thereof, the shaft 1 carries a crushing head 3. A first crushing means in the form of a first, inner, crushing shell 4 is mounted on the outside of the crushing head 3. In a machine frame 16, of which only a part is shown in FIG. 1, a second crushing means in the form of a second, outer, crushing shell 5 has been mounted in such a way that it surrounds the inner crushing shell 4.

Between the inner crushing shell 4 and the outer crushing shell 5, a crushing gap 6 is formed, which in axial section, as is shown in FIG. 1, has a decreasing width in the direction downwards. The shaft 1, and thereby the crushing head 3 and the inner crushing shell 4, is vertically movable by means of a hydraulic adjusting device, which comprises a tank 7 for hydraulic fluid, a hydraulic pump 8, optionally a gas-filled container 9 for attenuating rapid pressure variations, and a hydraulic cylinder 15. Thus, by controlling the supply of hydraulic fluid from the hydraulic pump 8 to the hydraulic cylinder 15 the vertical position of the shaft 1, and thereby the width of the crushing gap 6, can be controlled. The more narrow the width of the crushing gap 6, the higher the size reduction of the material passing through the crusher, and the higher the stresses in the crusher, at a constant amount of material fed to the crusher.

Furthermore, a motor 10 is connected to the crusher, which motor 10 during operation is arranged to bring the shaft 1, and thereby the crushing head 3, to execute a gyratory movement, i.e., a movement during which the two crushing shells 4, 5 approach each other along a rotary generatrix and distance from each other at a diametrically opposite generatrix. As illustrated in FIG., the motor 10 is operative for rotating an eccentric 17 which is arranged around the shaft 1 and is operative for making the same gyrate. In FIG. 1 the shaft 1 is in its forward position, due to this gyrating movement. A backward position would have a similar appearance as that of FIG. 1. A broken line denoted G1 in FIG. 1 indicates the position of the shaft 1 when it is in its left position due to the gyrating movement, and a broken line denoted G2 indicates the position of the shaft 1 when it is in its right position.

In operation, the crusher is controlled by a control device 11, which via an input 12' receives input signals from a transducer 12 arranged at the motor 10, which transducer measures the load on the motor, via an input 13' receives input signals from a pressure transducer 13, which measures the pressure in the hydraulic fluid in the hydraulic cylinder 15, and, finally, via an input 14' receives signals from a level transducer 14, which measures the position of the shaft 1 in the vertical direction in relation to the machine frame 16. The control device 11 comprises, among other things, a data processor and controls, on the basis of received input signals, among other things, the hydraulic fluid pressure in the hydraulic cylinder 15 by controlling the operation of the hydraulic pump 8, as indicated in FIG. 1.

The material being introduced in the crushing gap 6 formed between the two crushing shells 4, 5 will be compressed between these two shells 4, 5 as a result of the gyrating movement of the shaft 1 on which the crushing head 3 and the inner crushing shell 4 are mounted. As a result of this compression of the material the largest force $f_N(t)$, as illustrated in FIG. 1, will act on the left end portion of the outer crushing shell 5 when the shaft 1 is in its left position indicated by the broken line G1. The same force, but with the opposite direction, will act on the inner crushing shell 4. The largest force $f_N(t)$ acting on the outer shell 5 will have a vertical component $f_y(t)$ and a horizontal component $f_x(t)$, the largest force $f_N(t)$ hence being the resultant of those two components $f_y(t)$ and $f_x(t)$. These components will be balanced by corresponding components occurring in the machine frame 16. In a similar manner the force acting on the inner crushing shell 4 will be balanced by forces acting in the bearings of the shaft 1, such bearings not being illustrated in detail in FIG. 1 for the sake of clarity of illustration, and in the hydraulic cylinder 15. It will be appreciated, hence, that the location where the largest force $f_N(t)$ acts on the outer shell 5 will vary as the shaft 1 gyrates, and that the location on the outer shell 5 at which the largest force $f_N(t)$ acts, at a specific moment in time, will normally coincide with the position where the distance, at that same moment in time, between the inner and outer shells 4, 5 is the smallest.

Figure 2A:
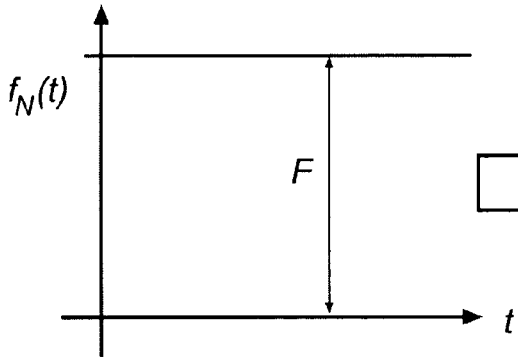
FIGS. 2*a* and 2*b* illustrate an ideal case of a constant force acting on a gyratory crusher, and the resulting stresses in the crusher.
Figure 2B:
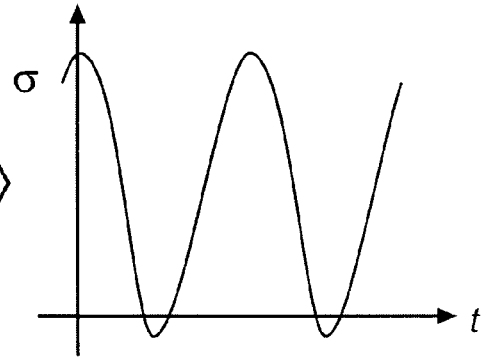

FIGS. 2*a* and 2*b* illustrate an ideal case in which the largest force $f_N(t)$ exerted on the outer crushing shell 5 is constant. FIG. 2*a* is a diagram and illustrates the largest force $f_N(t)$, e.g., in the unit kN, as a function of time, such force being constant at a value F in this idealized case. FIG. 2*b* illustrates the stresses a, e.g., in the unit $N/m^2$, as measured in a fixed point on the machine frame 16, e.g., in a point A illustrated in FIG. 1. One way of measuring the mechanical stresses in the crusher is to measure the mechanical stresses in the point A by means of, e.g., a strain gauge fixed to the machine frame 16 in the point A and sending signals to the control device 11, as indicated in FIG. 1. As can be seen from FIG. 2*b*, the stresses a in the fixed point A vary periodically as an effect of the gyratory movement of the shaft 1, even though the largest force $f_N(t)$ is constant at the force F. It is well known that stresses that change in magnitude may generate break-downs due to fatigue failure, and this is also the case in gyratory crushers.

Figure 3A:
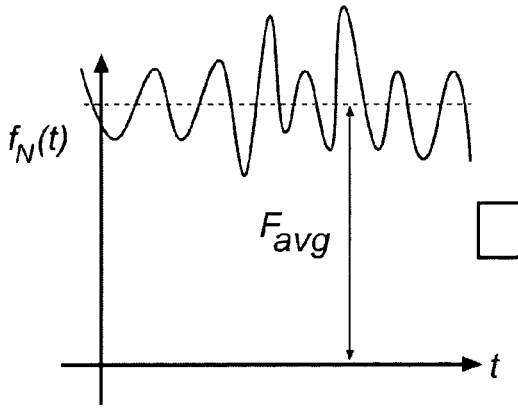
FIGS. 3*a* and 3*b* illustrate a real case of a force acting on a gyratory crusher, and the resulting stresses in the crusher.
Figure 3B:
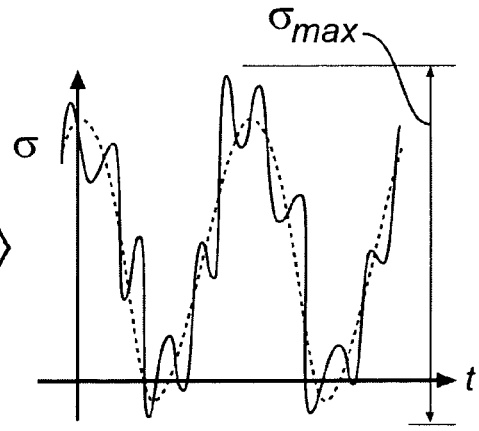

FIGS. 3*a* and 3*b* illustrate a real case in which the largest force $f_N(t)$ exerted on the outer crushing shell 5 varies. FIG. 3*a* is a diagram and illustrates the largest force $f_N(t)$, e.g., in the unit kN, as a function of time, such force varying around an average force $F_{avg}$ in this case. FIG. 3*b* illustrates the stresses a, e.g., in the unit $N/m^2$, as measured in a fixed point on the machine frame 16, e.g., in the point A illustrated in FIG. 1. As can be seen, the stresses a in the point A vary periodically as an effect of the gyratory movement of the shaft 1, and also vary due to the varying largest force $f_N(t)$. The dotted line in FIG. 3*b* indicate the varying stresses due to the gyrating movement and the average force $F_{avg}$, and the solid line in FIG. 3*b* indicates the real stresses, taking also the variations of the largest force $f_N(t)$ into account. It will be appreciated from a comparison between FIG. 2*b* and FIG. 3*b* that the stresses vary even more in the real case, and that the largest variation in stresses, denoted $\sigma_{max}$, is quite much larger in the real case illustrated in FIG. 3*b*.

Based on the relations illustrated in FIGS. 2*a*, 2*b*, 3*a* and 3*b* it would seem as if keeping the largest force $f_N(t)$ as low as possible would be beneficial to obtain a maximum technical life of the gyratory crusher. However, a high average force $F_{avg}$ is advantageous when it comes to crushing efficiency, since a high average force $F_{avg}$ means that the material to be crushed in the crusher undergoes a large reduction in size, which is what is desired for the crushing operation.

Figure 4A:
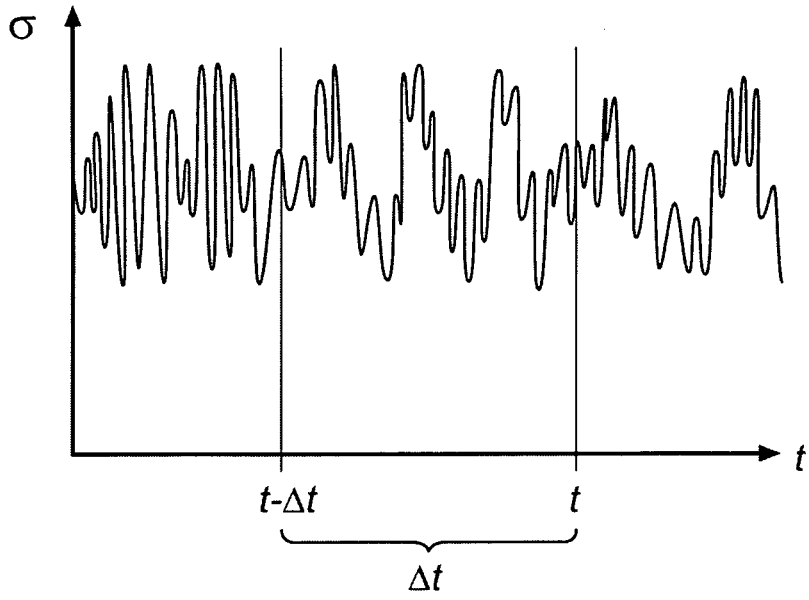
FIGS. 4*a* and 4*b* illustrate a method of calculating the peak stress generated in a crusher based on the average stress and the standard deviation of the stress.
Figure 4B:
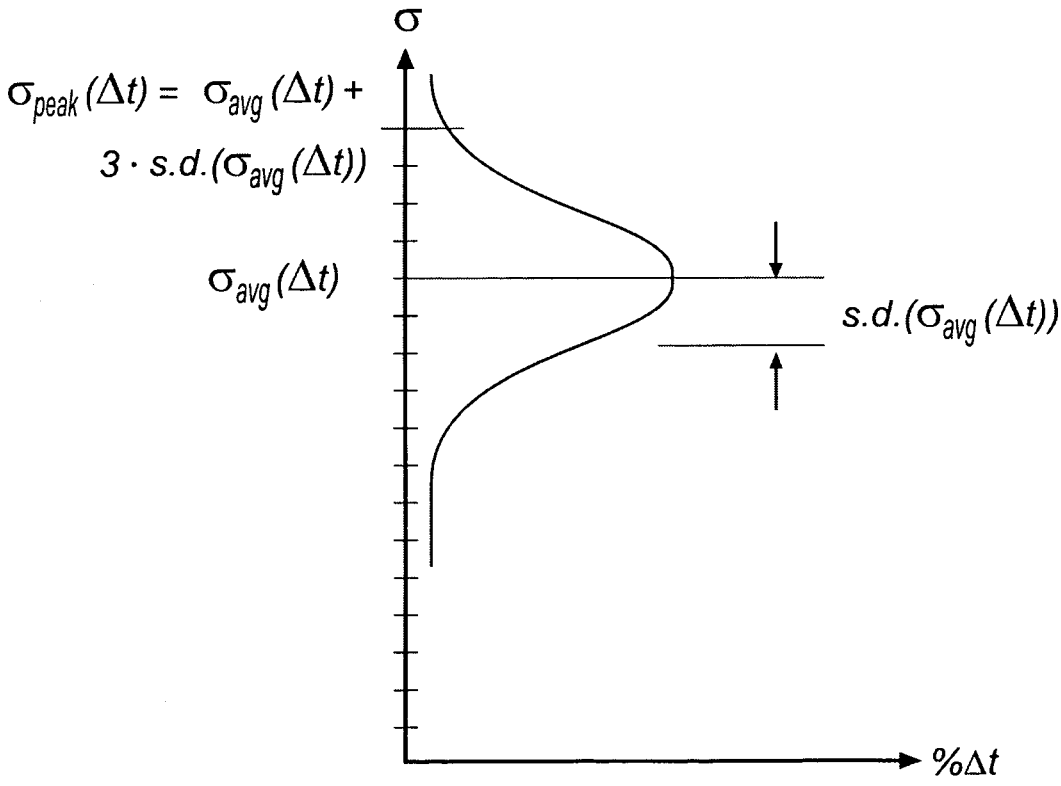

FIGS. 4*a* and 4*b* illustrate a method of controlling a gyratory crusher in view of the stresses to which it is exposed. FIG. 4*a* illustrates the stresses, σ, as a function of the time t. Typically the instant stress is measured, by means of, e.g., a strain gauge located in the point A illustrated in FIG. 1, 100-500 times per second. To calculate a moving average of the stresses a time interval of Δt is chosen, such time interval starting at t−Δt and ending at t. Typically, the length of the time interval Δt is a multiple of the rotation period of the eccentric of the crusher. As a typical example, the time interval Δt could be about 160 ms, corresponding to one typical rotation period of a typical gyratory crusher, thus yielding, at a sampling rate of 200 measurements per second, a total of 32 stress measurement values during the time interval Δt.

The stress measurement values obtained during the time interval Δt are evaluated by means of statistical methods that are per se known. FIG. 4*b* illustrates a distribution curve in which the stresses measured during the time interval Δt have been plotted versus the percentage of the time interval Δt that such stresses exists. As can be seen from FIG. 4*b* the stress measurement values appear to conform quite well with a normal distribution curve. From the measured stresses during the time interval Δt an average stress $\sigma_{avg}(\Delta t)$ can be calculated. Since the time interval Δt is updated every measurement cycle, meaning that in practical operation the time interval Δt is preferably updated at least once per minute, and typically more often than once per second, the average stress value $\sigma_{avg}(\Delta t)$ is a moving average that is also updated every measurement cycle. With the example above, with a sampling rate of 200 measurements per second, the average stress value $\sigma_{avg}(\Delta t)$, being a moving average, would be updated 200 times per second.

Furthermore, and as is also illustrated in FIG. 4*b*, a deviation value, which in this example is the standard deviation s.d.($\sigma_{avg}(\Delta t)$) of the stresses measured during the same time interval Δt is also calculated. Similar as with the average stress value $\sigma_{avg}(\Delta t)$, also the standard deviation s.d.($\sigma_{avg}(\Delta t)$) is a parameter that is preferably updated every measurement cycle.

Finally, a peak stress value $\sigma_{peak}(\Delta t)$ for the time interval Δt is calculated. The peak stress value $\sigma_{peak}(\Delta t)$ is the sum of the average stress value $\sigma_{avg}(\Delta t)$ multiplied by a first constant K1 and the standard deviation of the stress value s.d.($\sigma_{avg}(\Delta t)$) multiplied by a second constant K2, which will be discussed in more detail hereinafter. Hence, the peak stress value $\sigma_{peak}(\Delta t)$ could be calculated according to the following equation:

$$\sigma_{peak}(\Delta t)=K1*\sigma_{avg}(\Delta t)+K2*s.d.(\sigma_{avg}(\Delta t) \quad \text{[eq. 1.1]}$$

In the example illustrated in FIG. 4*b* K1 is equal to 1, and K2 is equal to 3.

Similar as with the average stress value $\sigma_{avg}(\Delta t)$ and the standard deviation s.d.($\sigma_{avg}(\Delta t)$), also the peak stress value $\sigma_{peak}(\Delta t)$ is a moving value which is updated every measurement cycle.

In the control of the gyratory crusher 1, the control device 11, illustrated in FIG. 1, compares the peak stress value $\sigma_{peak}(\Delta t)$ to a stress reference value $\sigma_{ref}$. The stress reference value $\sigma_{ref}$ may be a fixed value that is set to such a value that a desired relation between the technical life of the crusher and the crushing efficiency is obtained, such relation being based on, e.g., economical considerations.

If the peak stress value $\sigma_{peak}(\Delta t)$ exceeds the stress reference value $\sigma_{ref}$ then the control device 11 controls the crusher to decrease the stress. This can be obtained by, for example, feeding less material to the crusher, and/or by ordering the pump 8 to decrease the supply of hydraulic fluid to the hydraulic cylinder 15, illustrated in FIG. 1, to lower the shaft 1, such that the width of the crushing gap 6 is widened, resulting in a lower crushing efficiency, and a lower force being exerted on the crushing shells 4, 5. If, on the other hand, the peak stress value $\sigma_{peak}(\Delta t)$ is lower than the stress reference value $a_{ref}$ then the control device 11 controls the crusher to increase the stress, and the crushing efficiency. This can be obtained by, for example, feeding more material to the crusher, and/or by ordering the pump 8 to increase the supply of hydraulic fluid to the hydraulic cylinder 15, illustrated in FIG. 1, to rise the shaft 1, such that the width of the crushing gap 6 becomes more narrow, resulting in a higher crushing efficiency, and a higher force being exerted on the crushing shells 4, 5. The control device 11 may include a PID controller, and may utilize the stress reference value $\sigma_{ref}$ as a set point, to which the peak stress value $\sigma_{peak}(\Delta t)$ is compared.

Figure 5:
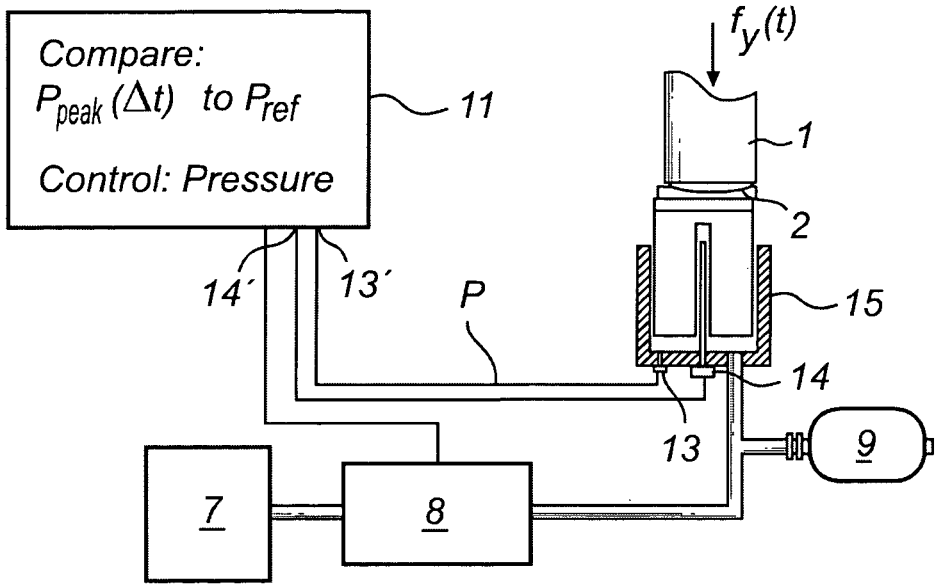
FIG. 5 illustrates a further example of how the gyratory crusher illustrated in FIG. 1 can be controlled.

FIG. 5 illustrates a further example of how the gyratory crusher illustrated in detail hereinbefore with reference to FIG. 1 can be controlled. As mentioned hereinbefore it is possible to measure the mechanical stresses in the crusher by means of a strain gauge sending a signal indicating the mechanical stress to the control device. An alternative to the strain gauge is to utilize another method measuring, indirectly, the mechanical stresses. As illustrated in FIG. 1 the largest force $f_N(t)$ acting on the outer shell 5 will have a vertical component $f_y(t)$ tending to force the outer shell 5 upwards. A force having a similar size as the largest force $f_N(t)$ but the opposite direction will act on the inner shell 4. This last mentioned force will have a vertical component $f_y(t)$ which will force the shaft 1 of the crusher downwards. FIG. 5 illustrates this vertical component $f_y(t)$ acting on the shaft 1. To balance the vertical component $f_y(t)$, such that the shaft 1 is kept in a constant vertical position, a suitable hydraulic pressure must be applied to the hydraulic cylinder 15 by means of the hydraulic pump 8. Thus, the hydraulic pressure measured by means of the pressure transducer 13 will be related to the magnitude of the vertical component $f_y(t)$, and will be well correlated with the peak stresses generated in the various parts of the gyratory crusher due to the action of the largest force $f_N(t)$.

Hence, the control device 11 will, as illustrated in FIG. 5, receive a pressure signal P from the pressure transducer 13 via the input 13'. The pressure signal P may be rather similar to the signal for the stresses σ illustrated in FIG. 4*a*. Based on the received pressure signal P the control device 11 may, for a time interval Δt, such time interval starting at t−Δt and ending at t, calculate an average pressure $P_{avg}(\Delta t)$, and a deviation value, such as a standard deviation s.d.($P_{avg}(\Delta t)$), of the pressure. From these values the control device 11 may then calculate a peak pressure value $P_{peak}(\Delta t)$ according to the following equation:

$$P_{peak}(\Delta t)=K1*P_{avg}(\Delta t)+K2*s.d.(P_{avg}(\Delta t)) \quad \text{[eq. 1.2]}$$

The average pressure value $P_{avg}(\Delta t)$, the standard deviation s.d.($P_{avg}(\Delta t)$), and the peak pressure value $P_{peak}(\Delta t)$ are each moving average values, that are updated on a regular basis, such as once every measurement cycle. Typically, the value of the first constant K1 could be about 1, and the value of the second constant K2 could be about 3, as will be discussed hereinafter.

The calculated peak pressure value $P_{peak}(\Delta t)$ is compared, in the control device 11, to a pressure reference value $P_{ref}$. The pressure reference value $P_{ref}$ may be a set value that is set to such a value that a desired relation between the technical life of the crusher and the crushing efficiency is obtained, such relation being based on, e.g., economical considerations.

If the peak pressure value $P_{peak}(\Delta t)$ exceeds the pressure reference value $P_{ref}$ then the control device 11 controls the crusher to decrease the pressure. This can be obtained by, for example, feeding less material to the crusher, and/or by sending a signal to the hydraulic pump 8 to decrease the pressure supplied to the hydraulic cylinder 15, to lower the shaft 1, such that the width of the crushing gap 6 is widened, resulting in a lower crushing efficiency, and a lower force being exerted on the crushing shells 4, 5. If, on the other hand, the peak pressure value $P_{peak}(\Delta t)$ is lower than the pressure reference value $P_{ref}$ then the control device 11 controls the crusher to increase the stress, and the crushing efficiency. This can be obtained by, for example, feeding more material to the crusher, and/or by ordering the hydraulic pump 8 to supply a higher pressure to the hydraulic cylinder 15, to rise the shaft 1, such that the width of the crushing gap 6 becomes more narrow, resulting in a higher crushing efficiency, and a higher force being exerted on the crushing shells 4, 5. The control device 11 may include a PID controller, and may utilize the pressure reference value $P_{ref}$ as a set point, to which the peak pressure value $P_{peak}(\Delta t)$ is compared. Typically, the control device 11 may be a computer, in which the various steps of calculating the peak pressure value and comparing it to a pressure reference value is implemented as a software that is run on a processor of said computer.

In comparison to the prior art, represented by, e.g., WO 2005/007293, the present method of controlling the gyratory crusher has a solid scientific ground as it is based on statistical concepts known per se, and accounts not only for the highest pressure values, as is the case in the method disclosed in WO 2005/007293, but also for the variation as such in the stresses, such variations being effectively accounted for by means of including the deviation value, such as the standard deviation, s.d.($\sigma_{avg}(\Delta t)$), when calculating the peak stress value $\sigma_{peak}(\Delta t)$.

By setting the first and second constants K1 and K2 to suitable values it will be possible to account for the crushers mechanical sensitivity to high average stresses vs. the crushers sensitivity to large variations in the stresses. Often it is suitable to set the first constant K1 to 1, and to adjust the second constant K2. For example, by setting a low constant K2, such as a value of 0.5 to 2, a low weight is given to the variation in the stresses, and a high weight is given to the average stresses. On the other hand, a high constant K2, such as a K2-value of 3.5-5, results in that a high weight is given to the variations in the stresses, and a low weight is given to the average stresses. Some crusher designs, such as larger crushers, might be more sensitive to large variations in the stresses, while other crushers, such as smaller crushers, might be more sensitive to large average stresses. Thus, the values of the constants K1 and K2 can be adapted to the crusher type in question. The relation between the first constant K1 and the second constant K2 could typically be 1:0.5-5. For example, the value of the first constant K1 may be 1, and the value of the second constant K2 would often be in the range of 1.5 to 4, more often in the range of 2-3.5. In FIG. 4*b* the $\sigma_{peak}(\Delta t)$ value resulting from a constant K1 of 1 and a constant K2 of 3 has been marked.

By the peak stress value $\sigma_{peak}(\Delta t)$ accounting for both the deviation value of the stresses, for example the standard deviation of the stresses s.d.($\sigma_{avg}(\Delta t)$), and the average stress $\sigma_{avg}(\Delta t)$ a more relevant relation between the way the crusher operation is controlled and the expected technical life can be obtained, since the fatigue failure in the gyratory crusher is caused by a combination of high stresses, as represented by the average stress $\sigma_{avg}(\Delta t)$, and high variations in the stresses, as represented by the deviation value of the stresses, for example the standard deviation of the stresses, s.d.($\sigma_{avg}(\Delta t)$). The control method also promotes operating the crusher in such a manner that the deviation of the stresses from the average stress is minimized. For example, by ensuring that the feeding of material to the crusher is even, an operator may achieve a low standard deviation in the stresses, such a low standard deviation making it possible to operate at a high average stress $\sigma\text{-}_{avg}(\Delta t)$, such average stress meaning an efficient crusher operation. Referring to equation 1.1 hereinbefore, it is clear that decreasing the standard deviation of the stresses, s.d.($\sigma_{avg}(\Delta t)$, makes it possible to increase the average stress $\sigma_{avg}(\Delta t)$ at a constant peak stress value $\sigma_{peak}(\Delta t)$.

Figure 6:
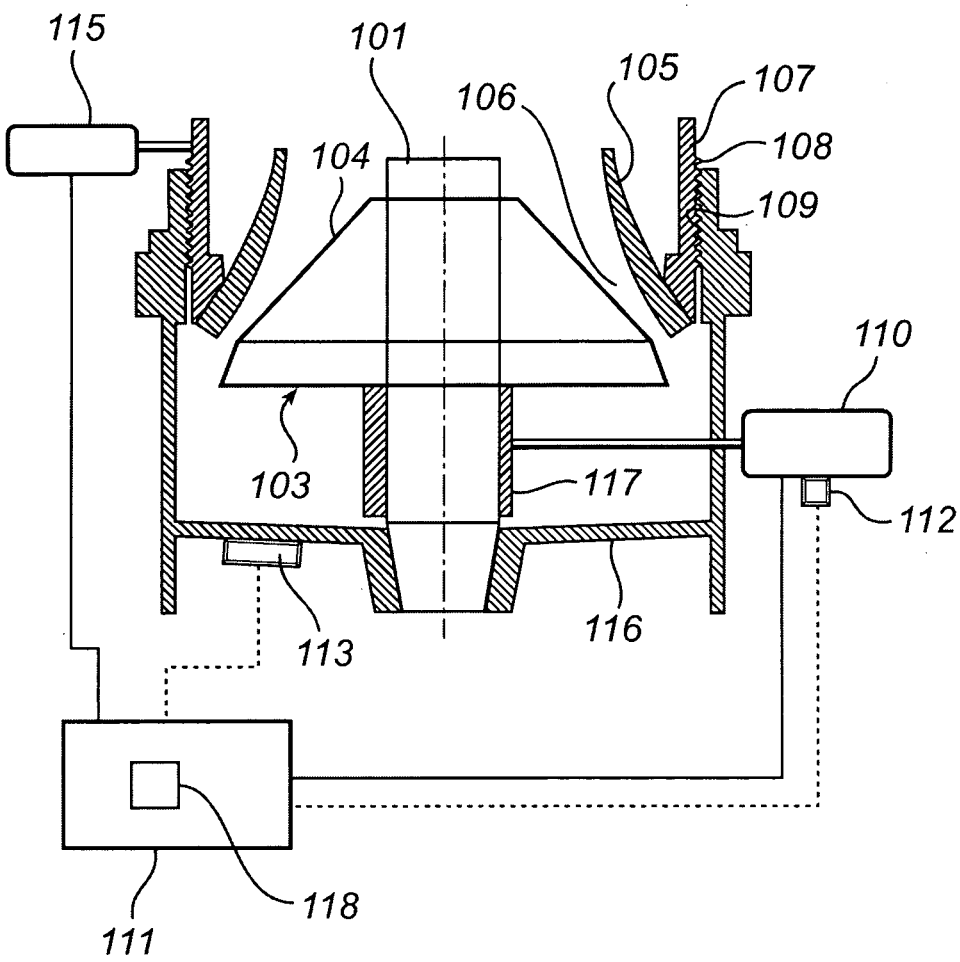
FIG. 6 illustrates a gyratory crusher according to a further embodiment.

FIG. 6 schematically illustrates a gyratory crusher that is of another type than the crusher shown in FIG. 1. The crusher shown in FIG. 6 has a fixed shaft 101, which carries a crushing head 103. An inner crushing shell 104 is mounted on the crushing head 103. Between the inner shell 104 and an outer crushing shell 105, a crushing gap 106 is formed. The outer crushing shell 105 is attached to a case 107 that has a trapezoid thread 108. The thread 108 mates with a corresponding thread 109 in a machine frame 116. Furthermore, a motor 110 is connected to the crusher to rotate an eccentric 117, which is rotatable around the fixed shaft 101, and to bring the crushing head 103, which is rotatable around the eccentric 117 and the fixed shaft 101, to obtain a gyratory movement during operation.

When the case 107 is turned by an adjustment motor 115 around the symmetry axis thereof, the outer crushing shell 105 will be moved vertically, the width of the gap 106 being changed. In this type of gyratory crusher, accordingly the case 107, the threads 108, 109 as well as the adjustment motor 115 constitute a adjusting device for adjusting of the width of the gap 106.

A transducer 112 is operative for measuring the instantaneous power generated by the motor 110. The measured power will be related to the stresses to which the crusher is exposed, and may be utilized as a parameter being representative of these stresses. Hence, based on the measured power, and in a similar manner as has been described hereinbefore with reference to FIGS. 1-5, the average power value, $Pow_{avg}(\Delta t)$, and the deviation value of the power, such as the standard deviation value of the power, s.d.($Pow_{avg}(\Delta t)$), can be calculated for the measured power during a time interval $\Delta t$. Then, a peak power value $Pow_{peak}(\Delta t)$ is calculated as the sum of the average power value multiplied by a first constant and the standard deviation value multiplied by a second constant, i.e., in a similar manner as has been described hereinbefore concerning eq. 1.1. Then the control device 111 compares the calculated peak power value $Pow_{peak}(\Delta t)$ to a power reference value $Pow_{ref}$. Depending on said comparison, the load on the crusher is controlled. The same control may, for instance, consist of the adjustment motor 115 being instructed to turn the case 107 in order to alter the width of the gap 106. It is also possible to alter the supply of material, the number of revolutions of the motor 110 and/or the stroke of the shaft 101 in the horizontal direction. An alternative method to control the crusher of FIG. 6, is to measure a mechanical stress or tension by means of a strain gauge 113, which, for example, may be placed on the machine frame 116 as illustrated in FIG. 6. The strain gauge 113, which measures the instantaneous stresses in the part of the frame 116 to which it is attached, is suitably placed on a location on the frame 116 which gives a representative picture of the mechanical stresses on the crusher. A peak stress value may then be calculated in a similar manner as has been described hereinbefore with reference to eq. 1.1.

The various steps of calculating a peak power value, comparing it to a power reference value, and controlling, e.g., the width of the gap 106, for example in accordance with a PID control principle, may be implemented in a software running on a processor 118 of the control device 111. In principle, hardware or firmware implementations would also be conceivable.

It will be appreciated that numerous modifications of the embodiments described above are possible within the scope of the appended claims.

Hereinbefore it has been described how the present invention may be applied to gyratory crushers having a hydraulic adjustment of the vertical position of the shaft 1, as illustrated with reference to FIG. 1, or having a mechanical adjustment of the vertical position of the outer shell 105, as illustrated in FIG. 6. It will be appreciated that the present invention can be applied to other types of gyratory crushers as well. One such gyratory crusher type is disclosed in WO 2008/103096. That gyratory crusher has a fixed shaft, and a crushing head rotating around said shaft, the vertical position of the crushing head being adjusted by means of a hydraulic device.

Hereinbefore it has been described that the crushing is controlled based on measurements of either the hydraulic pressure, or a measured mechanical stress, or a power supplied to motor driving a crusher. It will be appreciated that other measurements, that are representative of the stresses to which the crusher is exposed, could also be utilized for controlling the operation of the crusher. Furthermore, it would also be possible to control the crusher based on combinations of measured parameters, such as a combination of measured hydraulic pressure and measured power supplied to the motor.

Hereinbefore it has been described that the standard deviation value is utilized as a deviation value indicating the deviation, from the average, of the measured parameter being representative of the stresses to which the crusher is exposed during the crushing of material. It will be appreciated that other deviation values may also be utilized for representing this deviation. For example, it has been found that, based on the measured stress, which could, e.g., be measured by means of a strain gauge located in point A in the machine frame 16, as described hereinbefore with reference to FIG. 1, or indirectly by means of the pressure transducer 13, as described hereinbefore with reference to FIG. 5, it is possible to calculate the magnitude of the Fourier component at the frequency of rotation of the eccentric, in accordance with per se known mathematical methods. The magnitude of the Fourier component at the frequency of rotation of the eccentric could be utilized as a deviation value and can be added to the average value of the stress to obtain the peak stress value, the latter hence being the sum of the average stress value and the magnitude of the Fourier component. Furthermore, other deviation values calculated by means of per se known statistical methods may also be utilized. One such example is the average deviation, often called the average absolute deviation, which is calculated as the sum of absolute values of the deviations from the average value, during a certain period of time, divided by the number of observations during that period of time. A further example is the maximum absolute deviation which is the maximum absolute deviation from the average value during a certain period of time.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A method of controlling the operation of a gyratory crusher, which comprises a first crushing shell mounted on a crushing head, and a second crushing shell mounted on a machine frame, a crushing gap being formed between said first and second crushing shells, material to be crushed being fed to said crushing gap, comprising measuring a parameter being representative of the stresses to which the crusher is exposed during the crushing of material, determining an average value of said parameter, determining a deviation value of said parameter, calculating a peak value based on said average value and said deviation value, comparing said peak value to a reference value, and controlling the operation of the crusher in view of said comparison between said peak value and said reference value.

2. A method according to claim 1, wherein said parameter is chosen among a measured mechanical stress in the crusher, a pressure in a hydraulic system controlling the width of said crushing gap, and a power of a motor driving the crusher.

3. A method of claim 1, wherein said average value, said deviation value, and said peak value are determined based on values of said parameter measured during a time interval Δt that is a multiple of the rotation period of an eccentric of the crusher, said eccentric being operative for making the crushing head gyrate.

4. A method of claim 3, wherein said time interval At corresponds to from 1 to 10 rotation periods of the gyratory crusher.

5. A method of claim 1, wherein said average value, said deviation value, and said peak value are moving values.

6. A method of claim 1, further comprising controlling the width of said crushing gap in view of said comparison between said peak value and said reference value.

7. A method of claim 1, wherein said deviation value of said parameter is the standard deviation value of said parameter.

8. A method of claim 1, wherein the operation of the crusher that is controlled is a width of a crushing gap.

9. A method of controlling the operation of a gyratory crusher, which comprises a first crushing shell mounted on a crushing head, and a second crushing shell mounted on a machine frame, a crushing gap being formed between said first and second crushing shells, material to be crushed being fed to said crushing gap, comprising measuring a parameter being representative of the stresses to which the crusher is exposed during the crushing of material, determining an average value of said parameter, determining a deviation value of said parameter, calculating a peak value based on said average value and said deviation value, comparing said peak value to a reference value, and controlling the operation of the crusher in view of said comparison between said peak value and said reference value, wherein the calculation of said peak value comprises adding said average value of said parameter multiplied by a first constant, and said deviation value of said parameter multiplied by a second constant.

10. A method of controlling the operation of a gyratory crusher, which comprises a first crushing shell mounted on a crushing head, and a second crushing shell mounted on a machine frame, a crushing gap being formed between said first and second crushing shells, material to be crushed being fed to said crushing gap, comprising measuring a parameter being representative of the stresses to which the crusher is exposed during the crushing of material, determining an average value of said parameter, determining a deviation value of said parameter, calculating a peak value based on said average value and said deviation value, comparing said peak value to a reference value, and controlling the operation of the crusher in view of said comparison between said peak value and said reference value, wherein said peak value is calculated in accordance with the following equation:

$$\text{peak value} = K1 * \text{average value} + K2 * \text{deviation value}.$$

11. A method of claim 10, wherein K1 is about 1, and K2 is from about 0.5 to about 5.

12. A method of controlling the operation of a gyratory crusher, which comprises a first crushing shell mounted on a crushing head, and a second crushing shell mounted on a machine frame, a crushing gap being formed between said first and second crushing shells, material to be crushed being fed to said crushing gap, comprising measuring a parameter being representative of the stresses to which the crusher is exposed during the crushing of material, determining an average value of said parameter, determining a deviation value of said parameter, calculating a peak value based on said average value and said deviation value, comparing said peak value to a reference value, and controlling the operation of the crusher in view of said comparison between said peak value and said reference value, wherein said deviation value of said parameter is the magnitude of the Fourier component at the frequency of rotation of an eccentric of the crusher, said eccentric being operative for making the crushing head gyrate.

* * * * *